US010781618B2

(12) United States Patent
Mori

(10) Patent No.: US 10,781,618 B2
(45) Date of Patent: Sep. 22, 2020

(54) VEHICLE DOOR HINGE STRUCTURE

(71) Applicant: TOYOTA JIDOSHA KABUSHIKI KAISHA, Toyota-shi (JP)

(72) Inventor: Tatsunori Mori, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 9 days.

(21) Appl. No.: 16/215,696

(22) Filed: Dec. 11, 2018

(65) Prior Publication Data

US 2019/0194988 A1 Jun. 27, 2019

(30) Foreign Application Priority Data

Dec. 26, 2017 (JP) ..... 2017-249731

(51) Int. Cl.
*E05D 5/06* (2006.01)
*E05D 3/02* (2006.01)

(52) U.S. Cl.
CPC ..... *E05D 5/062* (2013.01); *E05D 3/02* (2013.01); *E05Y 2900/531* (2013.01)

(58) Field of Classification Search
CPC .. E05D 3/02; E05D 5/121; E05D 5/04; E05D 5/043; E05D 5/06; E05D 5/062; E05D 11/06; E05D 7/1044; E05D 7/121; E05D 2005/102; E05Y 2201/632; E05Y 2900/50; E05Y 2900/531; B60J 5/047
See application file for complete search history.

(56) References Cited

U.S. PATENT DOCUMENTS 3,006,039 A * 10/1961 Brydolf ..... E05D 5/06 49/398
3,628,216 A * 12/1971 Savell ..... E05D 3/10 16/287
4,542,558 A * 9/1985 Brockhaus ..... E05D 5/128 16/263
5,842,735 A * 12/1998 Makino ..... E05D 11/00 296/187.12
6,922,872 B2 * 8/2005 Gruber ..... E05D 5/062 16/222
7,089,626 B2 * 8/2006 Alexander ..... E05D 5/062 16/224
7,725,990 B2 * 6/2010 Patzold ..... E05D 11/00 16/387
7,895,712 B2 * 3/2011 Krumbiegel ..... E05D 7/121 16/355
7,908,712 B2 * 3/2011 Rudzewski ..... E05D 11/06 16/334
9,963,924 B2 * 5/2018 Moriyama ..... B60J 5/0472
(Continued)

FOREIGN PATENT DOCUMENTS

CN 107097615 A 8/2017
JP 2016-102307 6/2016
JP 2017-171113 9/2017

*Primary Examiner* — Chuck Y Mah
(74) *Attorney, Agent, or Firm* — Oblon, McClelland, Maier & Neustadt, L.L.P.

(57) ABSTRACT

A vehicle door hinge structure includes: a door-side hinge fixed to a side door of a vehicle; and a body-side hinge rotatably connected to the door-side hinge, the body-side hinge being fixed to a pillar of the vehicle at a position inward, in a vehicle width direction, of a connection part with the door-side hinge and at a height equal to or lower than a lower end of the door-side hinge in a vehicle up-down direction.

6 Claims, 9 Drawing Sheets

(56) References Cited

U.S. PATENT DOCUMENTS

| | | | | |
|---|---|---|---|---|
| 2004/0055112 | A1* | 3/2004 | Kiefer | E05D 5/062 16/302 |
| 2004/0111833 | A1* | 6/2004 | Janczak | E05D 5/0207 16/221 |
| 2004/0231103 | A1* | 11/2004 | Magnuson | E05D 5/121 16/340 |
| 2008/0295290 | A1* | 12/2008 | Murray | E05D 5/062 16/386 |
| 2009/0056074 | A1* | 3/2009 | Chase | E05D 5/062 16/321 |
| 2015/0026924 | A1* | 1/2015 | Morinaga | E05D 5/062 16/277 |
| 2015/0368945 | A1* | 12/2015 | Sasa | E05D 5/062 16/377 |
| 2017/0321463 | A1 | 11/2017 | Morinaga | |
| 2017/0350176 | A1* | 12/2017 | Rahman | E05D 3/02 |

* cited by examiner

VEHICLE DOOR HINGE STRUCTURE

INCORPORATION BY REFERENCE

The disclosure of Japanese Patent Application No. 2017-249731 filed on Dec. 26, 2017 including the specification, drawings and abstract is incorporated herein by reference in its entirety.

BACKGROUND

1. Technical Field

The disclosure relates to a vehicle door hinge structure.

2. Description of Related Art

Japanese Unexamined Patent Application Publication No. 2017-171113 (JP 2017-171113 A) describes a structure in which a bead extending in the vehicle front-rear direction is provided in a lower part of a B-pillar in order to improve strength of the lower part of the B-pillar. According to JP 2017-171113 A, with such a structure, a lateral load input from a front door or a side door at the time of a side collision of a vehicle is dispersed to a side sill via the bead. The strength of the lower part of the B-pillar is increased by dispersing the collision load as such.

SUMMARY

In the meantime, in the configuration described in JP 2017-171113 A, the bead for impact absorption at the time of a side collision is placed inwardly in the vehicle width direction from the side door. Here, in the configuration described in JP 2017-171113 A, a space is provided between the side door and the bead so that they do not interfere with each other at the time when the side door is opened or closed.

In the configuration where the space is provided as such, it takes some time until the side door deforms and interferes with the bead at the time of a side collision. That is, some time passes until the bead starts to absorb energy caused by the collision.

In consideration of such a point, there is room to improve a structure of a vehicle side portion so that a configuration around the side door of the vehicle can absorb or disperse an impact more efficiently.

The disclosure provides a vehicle door hinge structure that can disperse a collision load efficiently at the time of a side collision of a vehicle.

A first aspect of the disclosure provides a vehicle door hinge structure characterized by including: a door-side hinge fixed to a side door of a vehicle; and a body-side hinge rotatably connected to the door-side hinge, the body-side hinge being fixed to a pillar of the vehicle at a position inward, in a vehicle width direction, of a connection part with the door-side hinge and at a height equal to or lower than a lower end of the door-side hinge in a vehicle up-down direction.

In the above aspect, when the vehicle has a collision from a lateral direction, a collision load is first transmitted from the side door that has received the collision load to the door-side hinge via its fixation part. Then, the load transmitted to the door-side hinge is transmitted to the body-side hinge via the connection part. Further, the load input into the body-side hinge is input into the pillar to which the body-side hinge is fixed via its fixation part.

Here, the body-side hinge is fixed to the pillar of the vehicle at the height not higher than the lower end of the door-side hinge. On this account, the collision load is dispersed to a part below the height at which the load is input from the side door to the door-side hinge. That is, the collision load input from the side door via the door-side hinge is input into the pillar at the height not higher than the door-side hinge via the body-side hinge.

When the collision load is dispersed to the lower side distanced from the central part of the pillar of the vehicle in its height direction as such, a maximum value of a bending moment applied to the pillar can be reduced. This makes it possible to reduce a maximum deflection of the pillar.

Further, by dispersing the collision load to the lower side of the pillar, more of the load received by the pillar can be dispersed to peripheral members joined to the lower side of the pillar.

In the first aspect, the body-side hinge may be further fixed to the pillar of the vehicle at a height higher than the lower end of the door-side hinge.

With the configuration, the body-side hinge is fixed to the pillar in at least two positions, i.e., at a height higher than the lower end of the door-side hinge and at a height not higher than the lower end of the door-side hinge. Hereby, the fixation part provided at the height higher than the lower end of the door-side hinge serves as a supporting point, so that the collision load can be dispersed to the fixation part provided at the height not higher than the lower end of the door-side hinge.

A second aspect of the disclosure provides a vehicle door hinge structure including: a door-side hinge fixed to a side door of a vehicle; and a body-side hinge rotatably connected to the door-side hinge, the body-side hinge being fixed to a pillar of the vehicle at a position inward, in a vehicle width direction, of a connection part with the door-side hinge and at a height below the connection part in a vehicle up-down direction.

With the configuration, when the vehicle has a collision from a lateral direction, a collision load is first transmitted from the side door that has received the collision load to the door-side hinge via its fixation part. The load transmitted to the door-side hinge is transmitted to the body-side hinge via the connection part. Further, the load input into the body-side hinge is input into the pillar to which the body-side hinge is fixed via a fixation part between the body-side hinge and the pillar.

Here, the body-side hinge is fixed to the pillar of the vehicle at a position inward, in the vehicle width direction, of the connection part with the door-side hinge at a height below the lower end of the door-side hinge. On this account, the collision load is dispersed to a part below the connection part that is a transmission part of the load from the door-side hinge to the body-side hinge.

When the collision load is dispersed to the lower side distanced from the central part of the pillar of the vehicle in its height direction as such, a maximum value of a bending moment applied to the pillar can be reduced. That is, it is possible to reduce a maximum deflection of the pillar.

Further, by dispersing the collision load to the lower side of the pillar, the load received by the pillar can be dispersed and absorbed by other members joined to the lower side of the pillar.

In the second aspect, the body-side hinge may be further fixed to the pillar of the vehicle at a height equal to or higher than the connection part with the door-side hinge.

With the configuration, the body-side hinge is fixed to the pillar in at least two positions, i.e., at a height higher than the connection part with the door-side hinge and at a height not higher than the connection part with the door-side hinge. Hereby, the fixation part provided at the height higher than the connection part with the door-side hinge serves as a supporting point, so that the collision load can be dispersed to the fixation part provided at the height not higher than the connection part with the door-side hinge.

In the first aspect and the second aspect, the body-side hinge may include a first side face member extending inwardly in the vehicle width direction from the connection part with the door-side hinge and extending in the vehicle up-down direction, and a center of a rotation axis of the connection part between the body-side hinge and the door-side hinge may be placed on an extension line extending outwardly in the vehicle width direction from the first side face member.

With the configuration, the body-side hinge includes the first side face member extending inwardly in the vehicle width direction from the connection part with the door-side hinge and extending in the up-down direction. On this account, the collision load from a lateral side in the vehicle width direction can be efficiently transmitted to the body-side hinge. Further, since the first side face member is placed with a length to some extent in the vehicle width direction, the first side face member deforms at the time of a collision, so that the first side face member can absorb the collision load from the lateral side in the vehicle width direction.

Further, with the configuration, the center of the rotation axis of the connection part between the body-side hinge and the door-side hinge is placed on the extension line extending outwardly in the vehicle width direction from the first side face member. At the time when the vehicle receives a collision load from the lateral side, the load input into the side door is transmitted to the door-side hinge. Further, the load input into the door-side hinge is transmitted to the body-side hinge via the connection part with the body-side hinge. At this time, the load is applied inwardly in the vehicle width direction from the center of the rotation axis of the connection part between the body-side hinge and the door-side hinge. Here, with the vehicle door hinge structure as described above, the center of the rotation axis of the connection part between the body-side hinge and the door-side hinge is arranged linearly to the first side face member along the vehicle width direction, so that the load can be transmitted efficiently.

In the above configuration, the first side face member may become shorter in length along the vehicle width direction toward a lower side in the vehicle up-down direction from the connection part between the body-side hinge and the door-side hinge.

With the configuration, the load input from the door-side hinge is dispersed downward in the vehicle up-down direction via an outer end surface, in the vehicle width direction, of the first side face member in the body-side hinge. On this account, when the load is transmitted from the body-side hinge to the pillar, the load can be dispersed to a lower position.

In the above configuration, the body-side hinge may include a second side face member extending in a vehicle front-rear direction and extending in the vehicle up-down direction.

With the configuration, a wider area of a fixation surface between the body-side hinge and the pillar of the vehicle can be secured. This makes it possible to improve the strength of a joining part between the body-side hinge and the pillar. Further, when the area of the joining part becomes wider, it is possible to efficiently transmit the load. Further, the second side face member extends in the vehicle front-rear direction and extending in the up-down direction. With such a configuration, the input load can be more easily dispersed in the up-down direction, in comparison with a case where a side face member extending only in the vehicle front-rear direction is employed.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, with reference to the drawings, some embodiments of a vehicle door hinge structure of the disclosure will be described. Note that an arrow FR drawn as appropriate in each of the drawings indicates the front side in the vehicle front-rear direction, an arrow UP indicates the upper side in the vehicle up-down direction, and an arrow RH indicates the right side in the vehicle right-left direction. Hereinafter, in a case where a description is made by use of merely directions of front and rear, up and down, and right and left, they indicate the front and rear sides in the vehicle front-rear direction, the up and down sides in the vehicle up-down direction, and the right and left sides when a vehicle faces its traveling direction, respectively, unless otherwise specified.

First Embodiment

Figure 1:
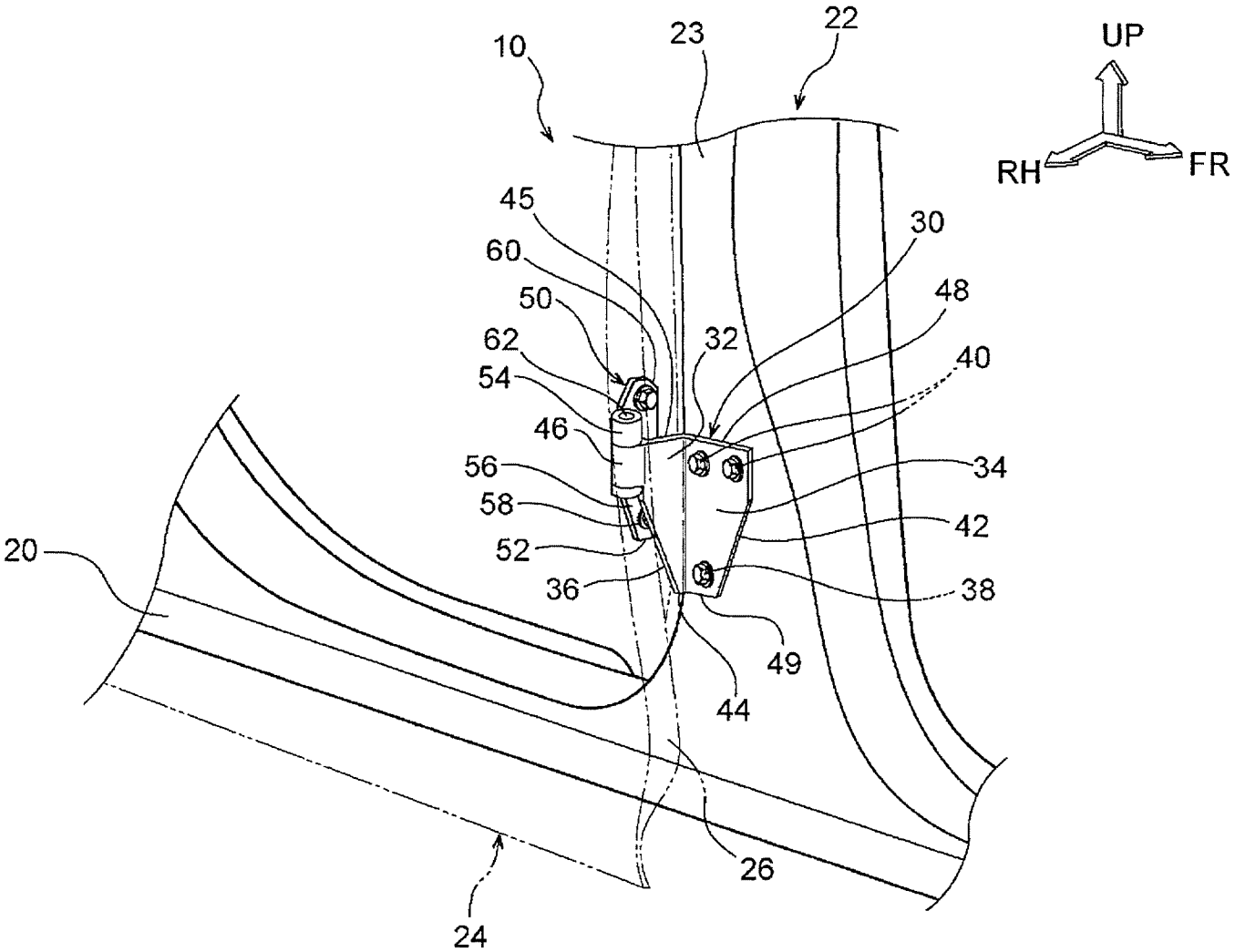
FIG. 1 is a perspective view illustrating a vehicle door hinge structure and some of its peripheral members in a first embodiment.

FIG. 1 illustrates a vehicle door hinge structure 10 and some of its peripheral members in the first embodiment. As illustrated in FIG. 1, the vehicle door hinge structure 10 of the present embodiment is attached to a pillar 22 provided in a side portion of a vehicle.

The vehicle door hinge structure 10 includes a body-side hinge 30, a pin 62, and a door-side hinge 50. Here, the body-side hinge 30 and the door-side hinge 50 are connected so that a body-side hinge connecting portion 46 and a door-side hinge connecting portion 54 are rotatable around the pin 62 serving as the axial center.

The body-side hinge includes the body-side hinge connecting portion, a first side face member 32, and a second side face member 34. Here, the body-side hinge connecting portion is placed on the outer side in the vehicle width direction. Further, the first side face member 32 is placed inwardly in the vehicle width direction from the body-side hinge connecting portion 46. Further, the second side face member 34 is placed inwardly in the vehicle width direction and forward in the vehicle front-rear direction from the first side face member 32.

The first side face member 32 of the body-side hinge 30 is placed so as to extend inwardly in the vehicle width direction from the body-side hinge connecting portion 46 and extend in the up-down direction. The first side face member 32 is shortened in dimension along the vehicle width direction as it goes downward from the body-side hinge connecting portion 46. More specifically, an outer end surface, in the vehicle width direction, of a part of the first side face member 32 below the body-side hinge connecting portion 46 is formed as an inclined portion 36 directed inwardly in the vehicle width direction toward the lower side.

A lower end 44 of the first side face member 32 in the body-side hinge 30 is placed below a door-side hinge lower end 52. Note that the door-side hinge lower end 52 is formed horizontally and lineally in the vehicle width direction.

The second side face member 34 is provided inwardly in the vehicle width direction from the first side face member 32. The second side face member 34 has a flat shape extending in the vehicle front-rear direction and extending in the vehicle up-down direction. The second side face member 34 is fixed to a pillar side face 23 provided on the outer side of the pillar 22 in the vehicle width direction.

A rear end surface, in the vehicle front-rear direction, of the second side face member 34 is connected to an inner end surface, in the vehicle width direction, of the first side face member 32. Note that, in the first embodiment, the first side face member 32 and the second side face member 34 are formed as an integrated member. Further, the first side face member 32 and the second side face member 34 are placed such that their flat surfaces are generally vertical to each other.

An inclined portion 42 inclined rearward is formed on a front end surface, in the vehicle front-rear direction, of the second side face member 34, below body-side hinge upper fixed portions 40 (described later).

An upper end 48 of the second side face member 34 has an end surface at the same height as an upper end 45 of the first side face member 32 and an upper end of the body-side hinge connecting portion 46. Further, a lower end 49 of the second side face member 34 has an end surface at the same height as the lower end 44 of the first side face member 32. Here, the lower end 49 of the second side face member 34 is placed below the door-side hinge lower end 52, similarly to the lower end 44 of the first side face member 32.

The second side face member 34 is fixed to the pillar 22 generally at the same height as the body-side hinge connecting portion 46. More specifically, the second side face member 34 is fastened to the pillar side face 23 at two positions in the vehicle front-rear direction with bolts (hereinafter, fastening parts thereof are referred to as the "body-side hinge upper fixed portions 40" as appropriate). Similarly, the second side face member 34 is fixed to the pillar 22 at a height below the door-side hinge lower end 52 (hereinafter, a fastening part thereof is referred to as a "body-side hinge lower fixed portion" as appropriate).

Figure 2:
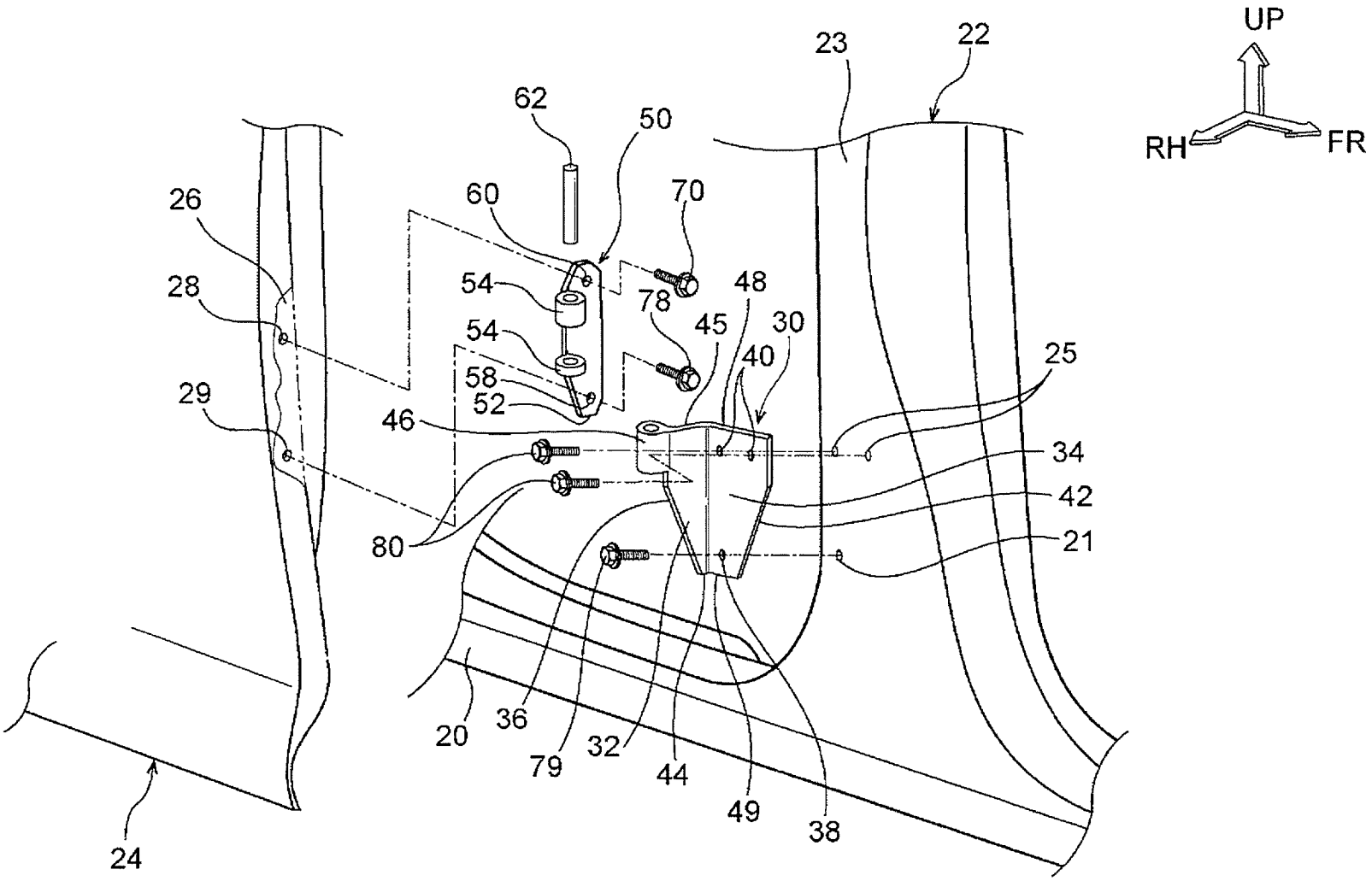
FIG. 2 is an exploded view illustrating the vehicle door hinge structure and some of the peripheral members in the first embodiment.

FIG. 2 is an exploded view of the vehicle door hinge structure 10 and some of its peripheral members in the first embodiment. Bolt-insertion holes are provided in an upper fixed portion 60 and a lower fixed portion 58 in the door-side hinge 50. Further, in an attachment part to the door-side hinge 50 in the side door 24, an upper fixed portion 28 and a lower fixed portion 29 are provided at positions corresponding to those holes. Further, bolt-insertion holes are provided in the upper fixed portion 28 and the lower fixed portion 29.

A bolt 70 is passed through the holes provided in the door-side hinge upper fixed portion 60 and the upper fixed portion 28 of the side door 24. Further, a nut (not shown) is provided at a corresponding position on the back of the front side face 26 of the side door, and when the bolt 70 is passed therethrough, the upper part of the door-side hinge 50 is fastened to the side door 24.

Similarly, a bolt 78 is passed through the holes provided in the door-side hinge lower fixed portion 58 and the lower fixed portion 29 of the side door 24. Further, a nut (not shown) is provided at a corresponding position on the back of the front side face 26 of the side door, and when the bolt 78 is passed therethrough, the lower part of the door-side hinge 50 is fastened to the side door 24.

In the meantime, bolts 80 are passed through two holes provided in the body-side hinge upper fixed portions 40 and two holes provided in upper fixed portions 25 of the pillar side face 23. Further, nuts (not shown) are provided at corresponding positions on the back of the pillar side face 23, and when the bolts 80 are passed therethrough, the upper part of the body-side hinge 30 is fastened to the pillar side face 23.

Similarly, a bolt 79 is passed through the holes provided in the body-side hinge lower fixed portion 38 and the lower fixed portion 21 of the pillar side face 23. Further, a nut (not shown) is provided at a corresponding position on the back of the pillar side face 23, and when the bolt 79 is passed therethrough, the lower part of the body-side hinge 30 is fastened to the pillar side face 23.

Impact Test

Next will be described an impact test to describe the operations and effects of the first embodiment with reference to FIG. 3.

Figure 3:
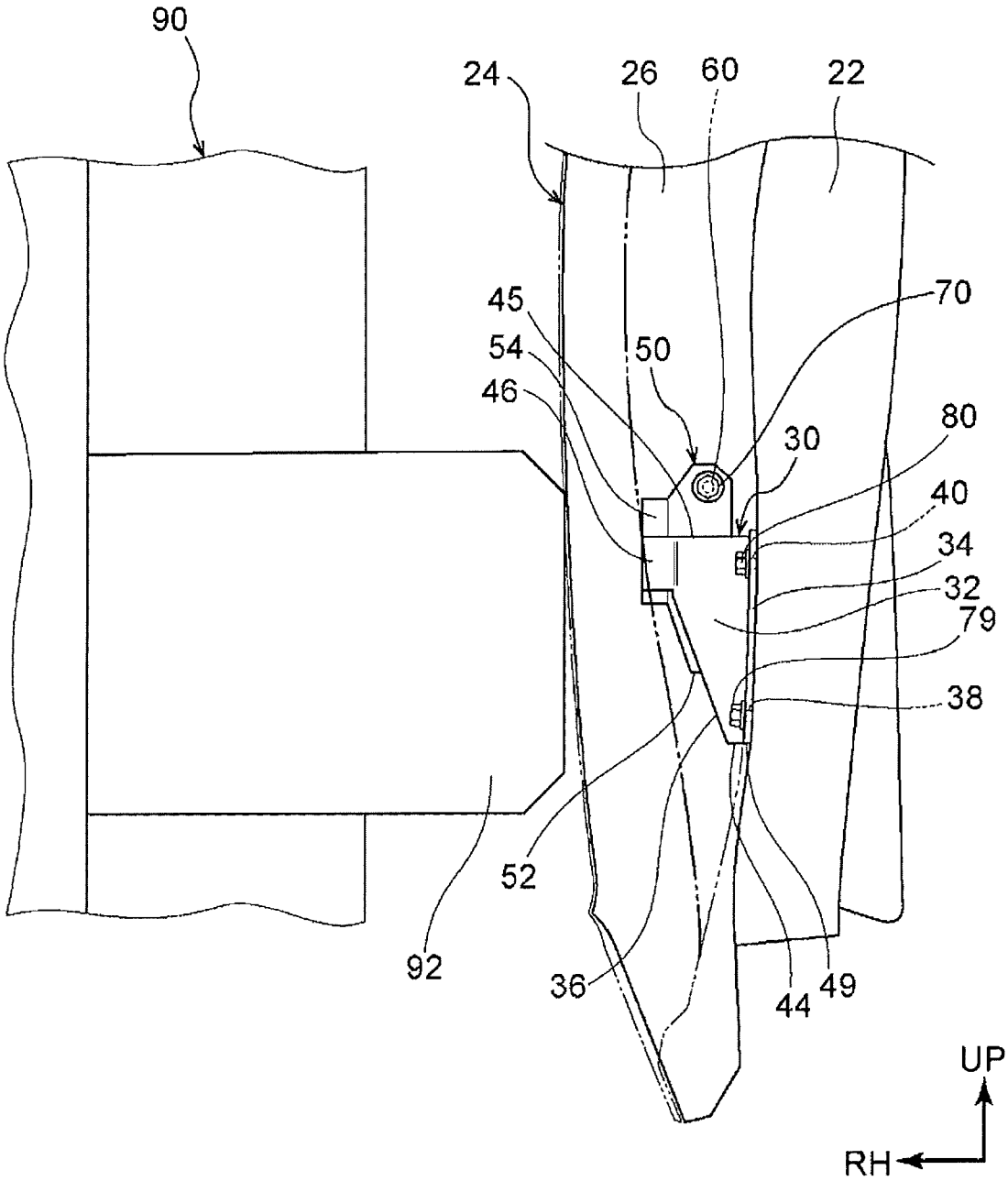
FIG. 3 is a schematic view illustrating, in a vehicle front view, a positional relationship between components at the time of an impact test in terms of the vehicle door hinge structure and the peripheral members in the first embodiment.

FIG. 3 schematically illustrates a positional relationship between components at the time of an impact test in terms of a vehicle provided with the vehicle door hinge structure 10 of the first embodiment. Note that FIG. 3 illustrates only the vehicle door hinge structure 10 and some components necessary for the description from among its peripheral components.

Here, the impact test to be used for the description is an SUV lateral collision test by the Insurance Institute for Highway Safety (IIHS) (hereinafter just referred to as "SUV lateral collision test" as appropriate). The SUV lateral collision test is a test in which a sport utility vehicle (SUV) with a high vehicle height collides with a general passenger vehicle from a lateral side. More specifically, a moving barrier having a weight of about 1500 kg collides with a side face of an immobile target vehicle at a speed of 50 km/h.

FIG. 3 illustrates a positional relationship between components related to the vehicle door hinge structure 10 at the time when a moving barrier 90 collides with the side door 24. A collision portion 92 imitating the bumper of the SUV is provided in the moving barrier 90 used in the SUV lateral collision test. The collision portion 92 is provided at a position higher than the height of a bumper of a passenger vehicle of a general sedan type. On this account, a collision load is input at a position close to a lower end side of the side door 24 in the target vehicle for the test.

In the first embodiment, the vehicle door hinge structure 10 is placed at a height generally corresponding to the collision portion 92 in the moving barrier 90. More specifically, the door-side hinge 50 and the body-side hinge connecting portion 46 in the body-side hinge 30 are placed between the heights of an upper end and a lower end of the collision portion 92.

Operations and Effects

Next will be described the operations and effects of the first embodiment with reference to FIGS. 4A to 7.

Figure 4B:
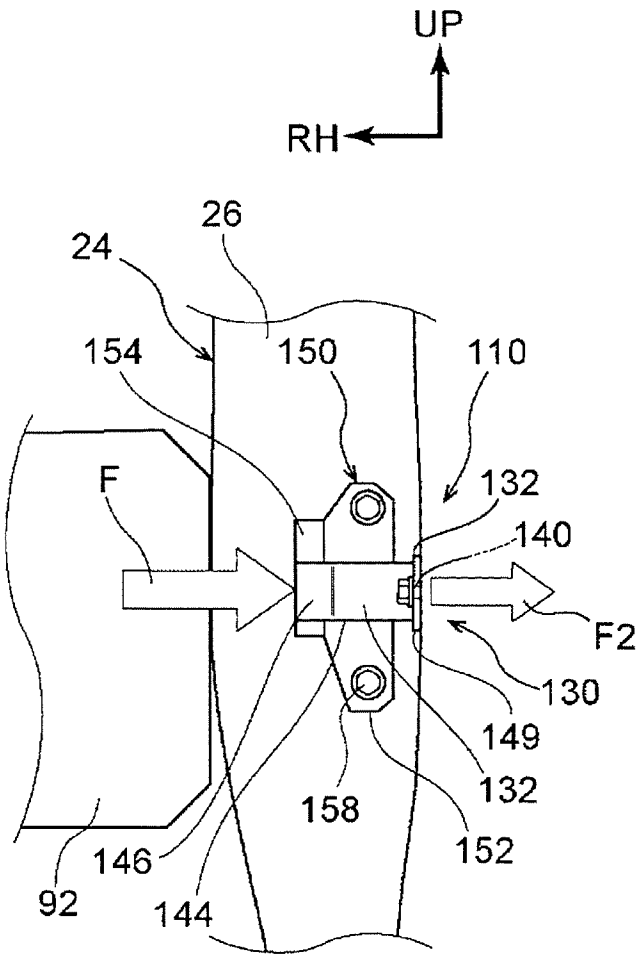
FIG. 4B is a schematic view illustrating how a load is transmitted when the impact test is performed on a vehicle door hinge structure in a reference example.
Figure 4A:
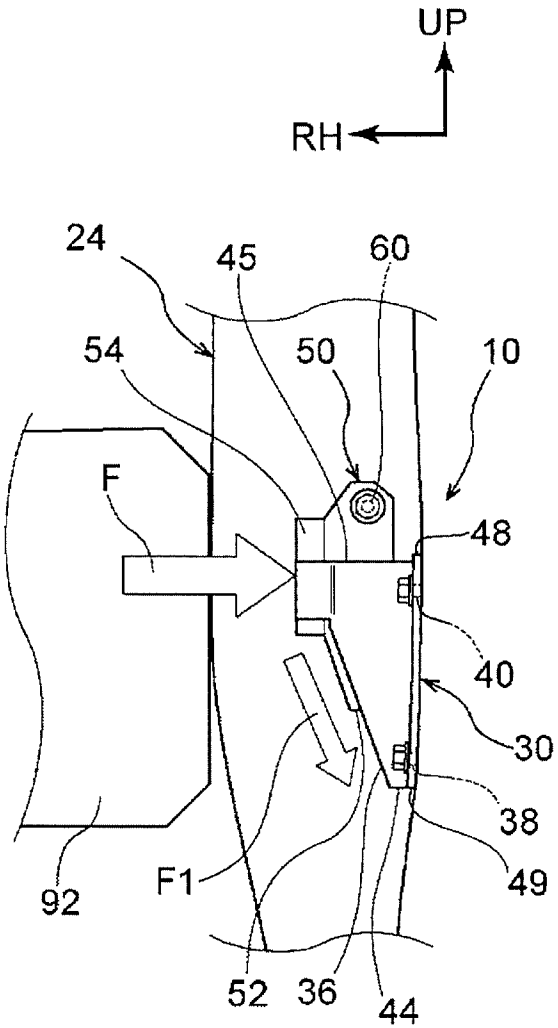
FIG. 4A is a schematic view illustrating how a load is transmitted when the impact test is performed on the vehicle door hinge structure in the first embodiment.

FIG. 4A schematically illustrates how a force is transmitted at the time of a collision in the vehicle door hinge structure 10 in the first embodiment and FIG. 4B schematically illustrates how a force is transmitted at the time of a collision in a vehicle door hinge structure 110 in a reference example.

First, FIG. 4A illustrates how a load is transmitted at the time of a side collision in the vehicle door hinge structure 10 in the first embodiment. A load F input from the collision portion 92 is transmitted to the side door 24. Then, the load is transmitted from the side door 24 to the door-side hinge 50 via the upper and lower door-side hinge fixed portions (60, 58). Further, the load input into the door-side hinge 50 is transmitted to the first side face member 32 in the body-side hinge 30 via the door-side hinge connecting portion 54 and the body-side hinge connecting portion 46.

Here, the first side face member 32 includes the inclined portion 36 inclined downward in the vehicle up-down direction and inwardly in the vehicle width direction. Meanwhile, the upper end 45 of the first side face member into which the load is input extends inwardly in the vehicle width direction in a generally horizontal manner. With such shapes of the upper end and the lower end, a part of the input load (a load F1) is dispersed downward in the vehicle up-down direction along the inclined portion 36.

As such, the load dispersed in the first side face member 32 is transmitted from the first side face member 32 to the second side face member 34. Then, the load is dispersed to the body-side hinge upper fixed portions 40 and the body-side hinge lower fixed portion 38 provided in the second side face member 34 and then transmitted to the pillar side face 23.

In the meantime, FIG. 4B illustrates how a load is transmitted at the time of a side collision in the vehicle door hinge structure 110 in the reference example. A load F input from the collision portion 92 is transmitted to the side door 24. Then, the load is transmitted from the side door 24 to a door-side hinge 150 via upper and lower door-side hinge fixed portions (160, 158). Further, the load input into the door-side hinge 150 is transmitted to a first side face member 132 in a body-side hinge 130 via a door-side hinge connecting portion 154 and a body-side hinge connecting portion 146.

Differently from the vehicle door hinge structure 10 in the first embodiment, the first side face member 132 in the reference example does not include the inclined portion 36 inclined downward in the vehicle up-down direction and inwardly in the vehicle width direction. Instead, a lower end of the first side face member 132 extends horizontally toward the inner side in the vehicle width direction at the same height as the body-side hinge connecting portion 146. With the shapes of an upper end and the lower end formed as such, the input load is horizontally transmitted to the pillar side face 23 as it is.

That is, when the vehicle door hinge structure 10 (FIG. 4A) in the first embodiment is compared with the vehicle door hinge structure 110 (FIG. 4B) in the reference example, the position of the load input into the pillar 22 is dispersed downwardly in the case of the vehicle door hinge structure 10.

Figure 5:
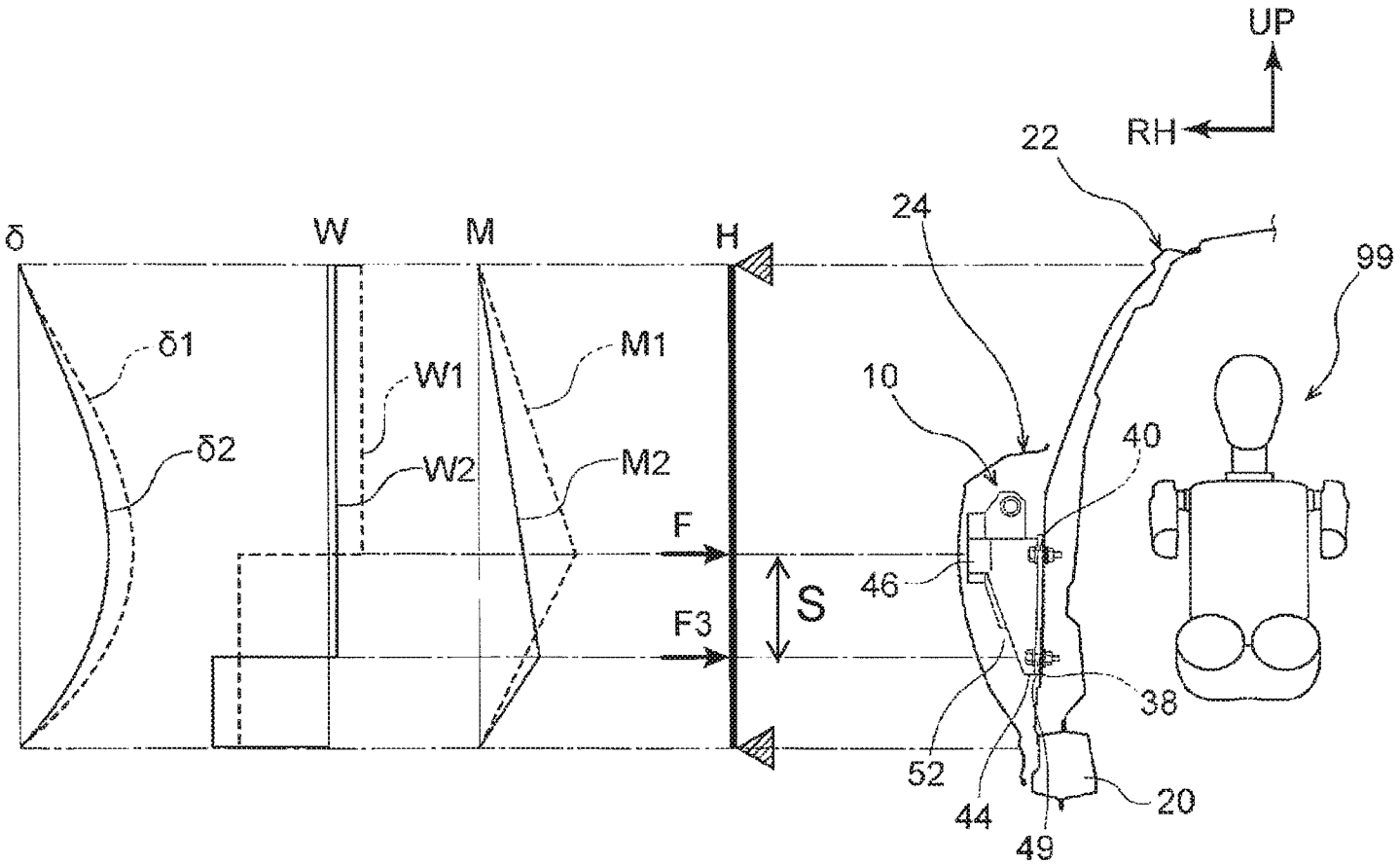
FIG. 5 is a schematic view illustrating the operations of the vehicle door hinge structure in the first embodiment.

FIG. 5 illustrates the operations of the first embodiment. More specifically, FIG. 5 schematically illustrates how a bending moment M, a shear force W, and a deflection δ applied to the pillar 22 change when a load distribution to the pillar 22 is dispersed downwardly by employing the vehicle door hinge structure 10 of the first embodiment. Note that FIG. 5 briefly illustrates the operations by replacing the pillar 22 with a both-ends supported beam H.

A load F illustrated in the beam H of FIG. 5 schematically illustrates a collision load input by a side collision. In a case where the vehicle door hinge structure 110 (FIG. 4B) of the reference example is employed, the load is expected to be transmitted to this position in the pillar 22. In addition to this, a load F3 moved downward only by a length S is schematically illustrated in the beam H of FIG. 5 for comparison. Here, the load F and the load F3 are illustrated as loads having the same magnitude for comparison.

As illustrated in FIG. 5, when a bending moment M1 by the load F applied at a position close to the center of the beam H is compared with a bending moment M2 by the load F3 applied to a position near a lower end of the beam H, it is found that M2 has a smaller absolute value. Similarly, a shear force by the load F is indicated by W1 and a shear force by the load F3 is indicated by W2. In such a state, a deflection δ2 by the load F3 is smaller than a deflection δ1 by the load F.

That is, by dispersing (moving) the position of the load applied to the pillar 22 from a side closer to the center in the up-down direction to the end (on the lower side) by use of the vehicle door hinge structure 10 of the first embodiment, a deformation amount of the pillar 22 toward the inner side in the vehicle width direction can be reduced. This makes it possible to reduce the possibility that the pillar 22 deforms and interferes with an occupant (a dummy 99 in FIG. 5) in the vehicle at the time of a collision.

Figure 6:
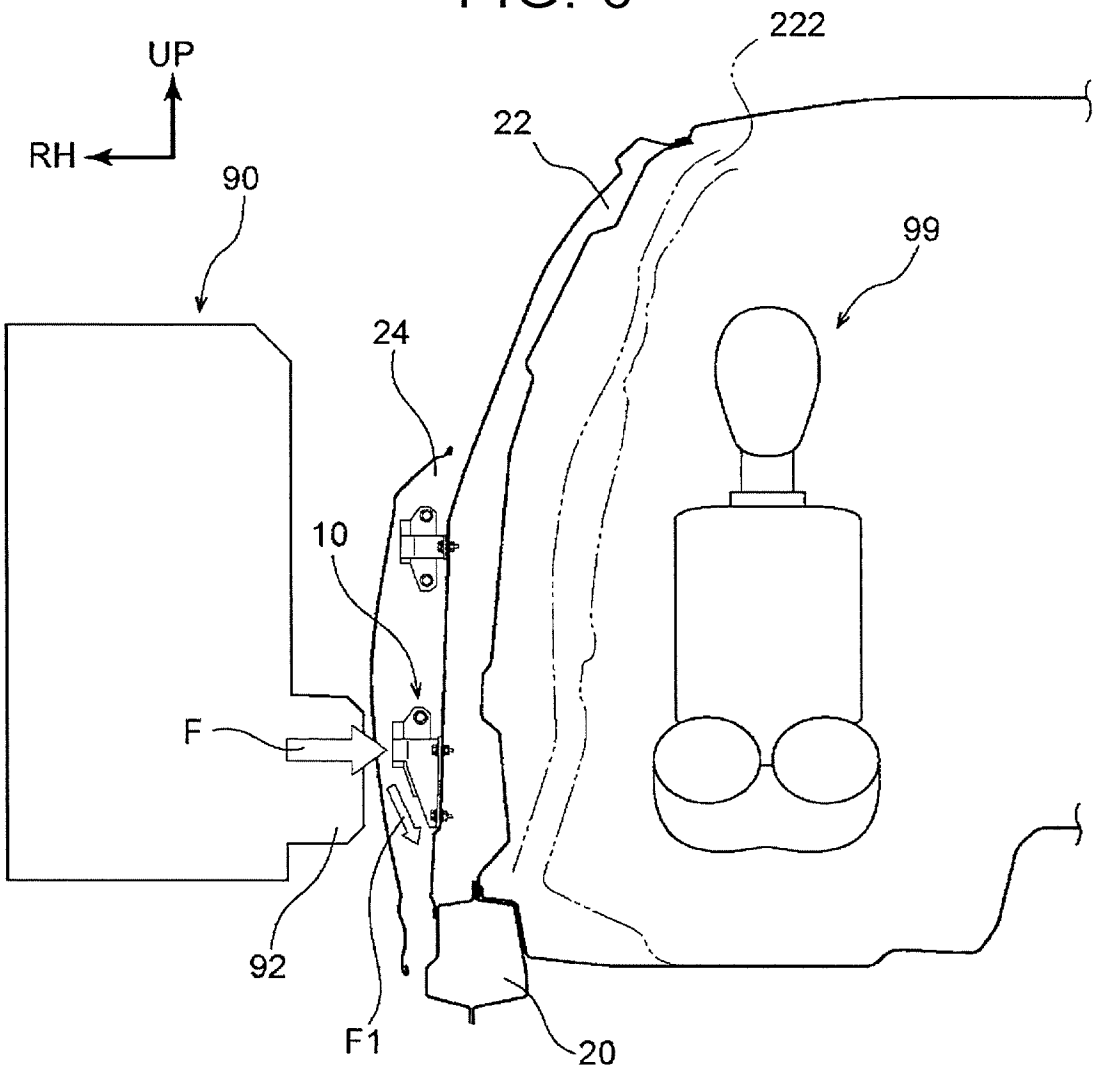
FIG. 6 is a view illustrating the operations of the vehicle door hinge structure in the first embodiment in the vehicle front view.

FIG. 6 schematically illustrates, in a vehicle front view, a predicted deformation of the pillar 22 (a deformed pillar 222) at the time when an impact test is performed on a vehicle provided with the vehicle door hinge structure 10 of the first embodiment. Here, a load F input from the collision portion 92 of the barrier is partially dispersed (a load F1) downward in the vehicle up-down direction by the vehicle door hinge structure 10. As a result, the load received by the pillar 22 is reduced, so that its deformation amount is reduced. This decreases the probability that the deformed pillar 222 makes contact with the occupant (the dummy 99).

Figure 7:
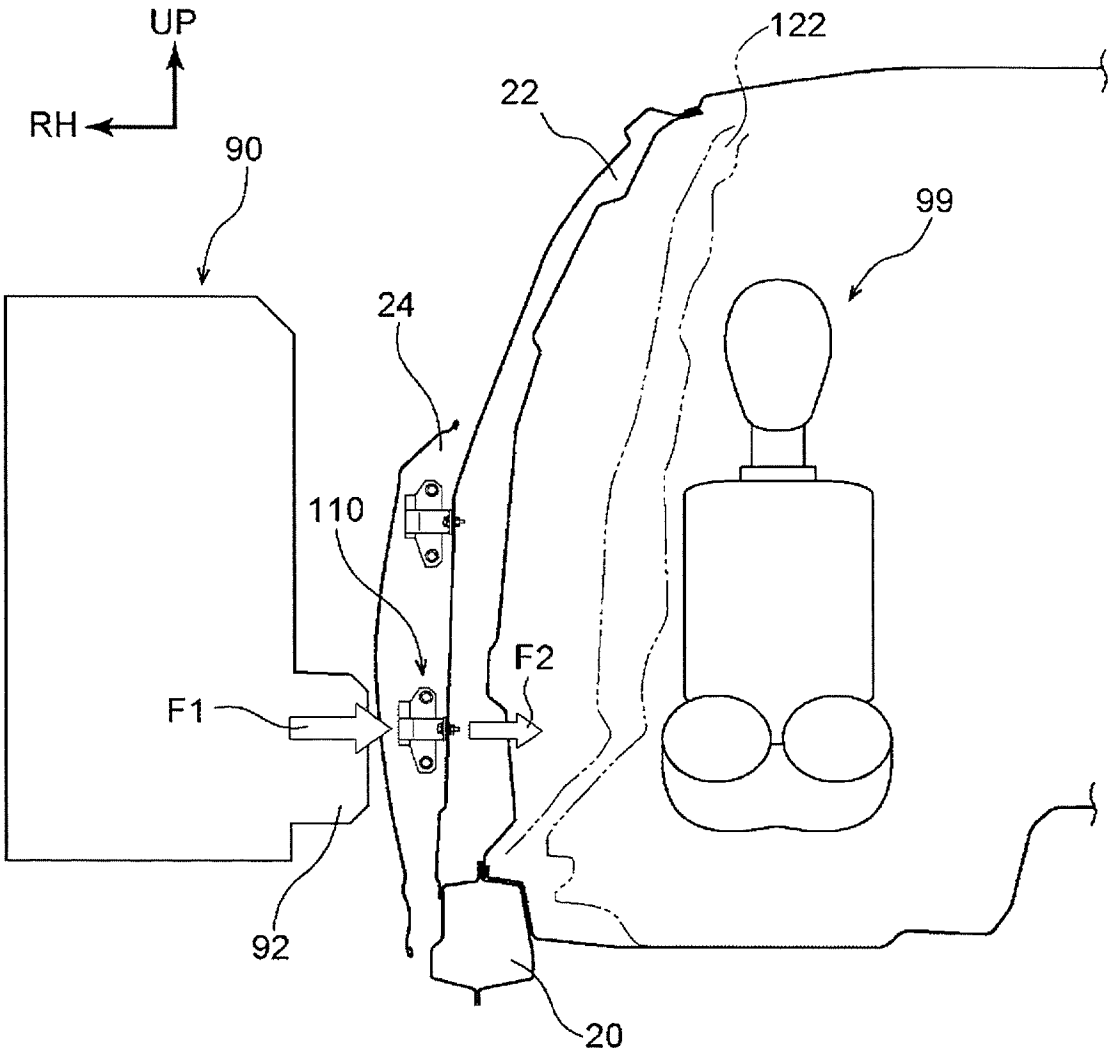
FIG. 7 is a view illustrating the operations of the vehicle door hinge structure in the reference example in a vehicle front view.

In the meantime, FIG. 7 schematically illustrates, in a vehicle front view, a predicted deformation (a deformed pillar 122) of the pillar 22 at the time when an impact test is performed on a vehicle provided with the vehicle door hinge structure 110 of the reference example. Here, a load F input from the collision portion 92 of the barrier is input into the pillar 22 without being dispersed downward. That is, in comparison with the case of FIG. 6, the load is input to a position close to the center of the pillar 22 in the up-down direction. Hereby, the vehicle (FIG. 7) provided with the vehicle door hinge structure 110 of the reference example largely deforms inwardly in the vehicle width direction, in comparison with the vehicle (FIG. 6) provided with the vehicle door hinge structure 10 of the first embodiment.

Second Embodiment

Next will be described a vehicle door hinge structure of the second embodiment. Note that the door hinge structure of the second embodiment is a modification of the first embodiment. Accordingly, a constituent common with the first embodiment has a corresponding reference sign, and a description thereof is omitted.

Figure 8:
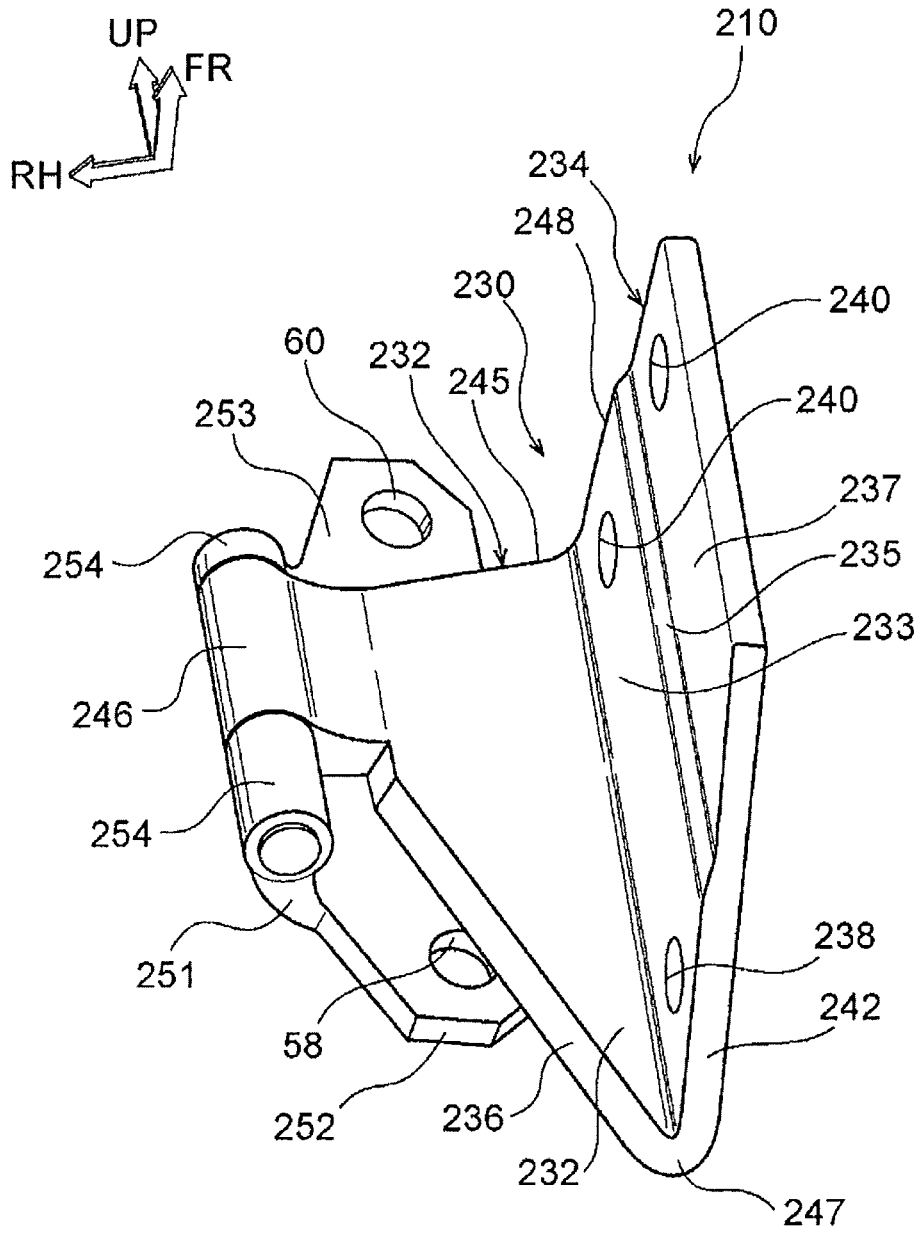
FIG. 8 is a perspective view of a vehicle door hinge structure in a second embodiment.

FIG. 8 illustrates a vehicle door hinge structure 210 of the second embodiment. In the second embodiment, a door-side hinge 250 includes a bending portion 251 between a door-side hinge fixed surface 253 fixed to the side door and a door-side hinge connecting portion 254. The bending portion 251 arcuately bends forward in the vehicle front-rear direction from the door-side hinge fixed surface 253 side. Since the bending portion 251 is provided, the door-side hinge connecting portion 254 is placed forward in the vehicle front-rear direction from a flat surface of the door-side hinge fixed surface 253.

A body-side hinge connecting portion 246 rotatably connected to the door-side hinge connecting portion 254 is placed outwardly in the vehicle width direction from a first side face member 232 of a body-side hinge 230. Here, the center of a rotation axis of the body-side hinge connecting portion 246 is placed on an extension line (toward the outer side in the vehicle width direction) from a plane formed by the first side face member 232.

A body-side hinge lower end 247 of the first side face member 232 is placed below a door-side hinge lower end 252. In the meantime, an upper end 245 of the first side face member is placed at the same height as an upper end of the body-side hinge connecting portion 246. Further, the first side face member 232 includes an inclined portion 236 extending inwardly in the vehicle width direction and downward on an outer end surface in the vehicle width direction such that the inclined portion 236 is placed below the body-side hinge connecting portion 246.

A second side face member 234 is placed inwardly in the vehicle width direction from the first side face member 232. The second side face member 234 has a generally flat shape along the side face of the vehicle. More specifically, the second side face member 234 has a generally flat shape extending forward in the vehicle front-rear direction and downward in the vehicle up-down direction.

The second side face member 234 includes an upper end 248 at the same height as the body-side hinge connecting portion 246 and the upper end 245 of the first side face member. Further, a lower end of the second side face member 234 includes an inclined portion 242 extending downward in the vehicle up-down direction and rearward in the vehicle front-rear direction. A starting point (an upper end) of the inclined portion is placed above the door-side hinge lower end 252 and the door-side hinge lower fixed portion 58 but below body-side hinge upper fixed portions.

An inclined portion 235 directed inwardly in the vehicle width direction and forward in the vehicle front-rear direction is provided in a generally central part of the second side face member 234 in vehicle front-rear direction. The inclined portion 235 extends in the vehicle up-down direction. From the inclined portion, the thickness of a rear flat surface 233, in the vehicle front-rear direction, of the second side face member 234 becomes thicker than that of a front flat surface 237 thereof in the vehicle front-rear direction.

Operations and Effects

Next will be described the operations and effects of the second embodiment.

In the vehicle door hinge structure 210 of the second embodiment, the body-side hinge connecting portion 246, the door-side hinge connecting portion 254, and the first side face member 232 are placed linearly in the vehicle width direction due to the bending portion 251. Hereby, a collision load from a lateral direction can be efficiently transmitted to the body-side hinge 230.

Further, the lower end of the body-side hinge 230 is provided with the inclined portion 236 and the inclined portion 242. With those inclined portions, the vehicle door hinge structure 210 of the second embodiment can be attached to a vehicle designed such that its lower side is inclined inwardly in the vehicle width direction or attached to a part having no attachment space in a lower part on the front side in the vehicle front-rear direction.

Further, in the vehicle door hinge structure 210 of the second embodiment, the thickness of the front flat surface of the body-side hinge is thin. Hereby, even in a case where an attachment part on the front side in the vehicle front-rear direction is narrow, the vehicle door hinge structure 210 can be attached thereto.

Third Embodiment

Next will be described a vehicle door hinge structure of the third embodiment. Note that the door hinge structure of the third embodiment is a modification of the first embodiment and the second embodiment. Accordingly, a constituent common with the first embodiment and the second embodiment has a corresponding reference sign, and a description thereof is omitted.

Figure 9:
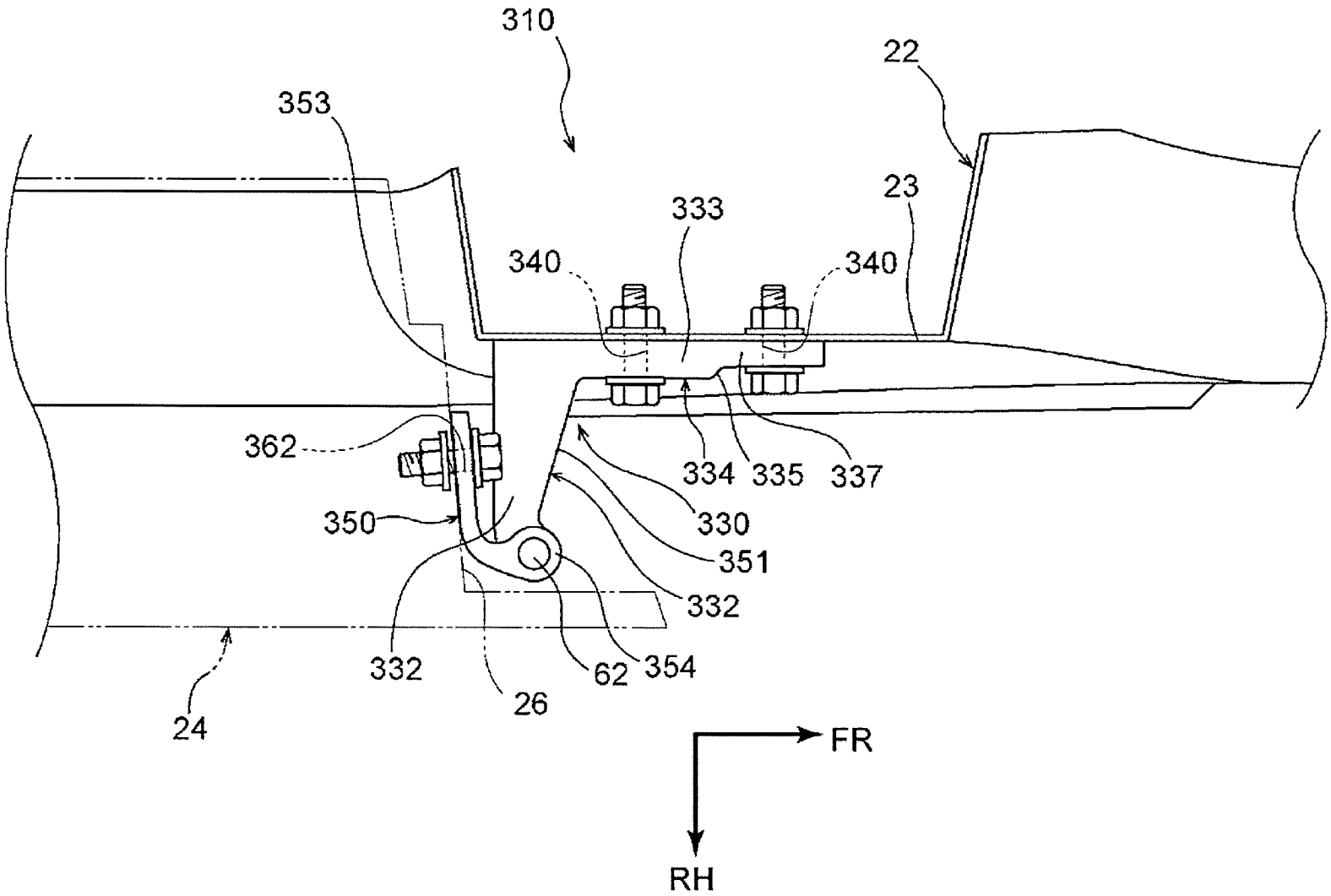
FIG. 9 is a top view of a vehicle door hinge structure in a third embodiment.

FIG. 9 illustrates a top view of a vehicle door hinge structure 310 of the third embodiment together with a partial sectional view of its peripheral members. As illustrated in FIG. 9, a door-side hinge 350 of the third embodiment is fixed to the front side face 26, in the vehicle front-rear direction, of the side door 24. A door-side hinge upper fixed portion 362 is fixed by a bolt and a nut. Similarly, a door-side hinge lower fixed portion (not shown) is also fixed by a bolt and a nut.

In the meantime, a body-side hinge 330 is fixed to the pillar side face 23 on the outer side of the pillar 22 in the vehicle width direction at body-side hinge upper fixed portions 340 by bolts and nuts. Similarly, a body-side hinge lower fixed portion (not shown) is fixed thereto by a bolt and a nut.

As illustrated in FIG. 9, a door-side hinge connecting portion 354 of the door-side hinge 350 is placed outwardly, in the vehicle width direction, from a first side face member 332 of the body-side hinge 330. Here, a rear flat surface, in the vehicle front-rear direction, of the first side face member 332 is a vertical surface 353 extending in the vehicle width direction. In the meantime, a front flat surface, in the vehicle front-rear direction, of the first side face member 332 is an inclined portion 351 inclined inwardly in the vehicle width direction and forward in the vehicle front-rear direction.

Similarly to the vehicle door hinge structure 210 of the second embodiment, a second side face member 334 placed inwardly in the vehicle width direction from the first side face member 332 includes an inclined portion 335. Accordingly, a rear flat surface 333 on the rear side in the vehicle front-rear direction is thicker than a front flat surface 337 on the front side in the vehicle front-rear direction.

Operations and Effects

Next will be described the operations and effects of the third embodiment.

When the side door 24 receives a collision load by a side collision, the load is transmitted to the door-side hinge 350 via the fixed portion 362. Further, the collision load thus transmitted is transmitted from the door-side hinge connecting portion 354 to the first side face member 332 of the body-side hinge 330 via a body-side hinge connecting portion (not shown).

Here, the vehicle door hinge structure 310 of the third embodiment includes the inclined portion 351 in the first side face member 332. Hereby, the load is transmitted to the inclined portion 351 and dispersed forward in the vehicle front-rear direction. As a result, deformation of the first side face member 332 is restrained as compared with a case where the inclined portion 351 is not provided. That is, the ratio of the load to be transmitted to the second side face member via the first side face member 332 is increased. Hereby, a collision load is efficiently dispersed to the fixed portion.

The vehicle door hinge structures of the embodiments have been described above, but it is needless to say that the disclosure may be performable in various aspects as long as the various aspects are not beyond the gist thereof. For example, the vehicle door hinge structure in each of the embodiments is not limited to a door hinge on the lower side in the vehicle up-down direction, but may be employed as a door hinge on the upper side in the vehicle up-down direction. Further, in this case, the inclined portion to be provided in the first side face member of the body-side hinge may be provided on the upper end face of the first side face member so as to be inclined upward in the vehicle up-down direction. Further, in each of the embodiments, a fixation method of the vehicle door hinge structure is fixation by a bolt, but the fixation method may be replaced with other methods such as welding as long as the effects of the disclosure are not impaired remarkably. In each of the embodiments, the body-side hinge upper fixed portions positions generally at the same height as the body-side hinge connecting portion, but the body-side hinge upper fixed portions may position at higher positions than the body-side hinge connection portion.

What is claimed is:

1. A vehicle door hinge structure comprising:

a door-side hinge fixed to a side door of a vehicle; and a body-side hinge including a connection part that is rotatably connected to the door-side hinge, the body-side hinge being fixed to a pillar of the vehicle at a first fixing point that is inward, in a vehicle width direction, of the connection part and the first fixing point being at a height equal to or lower than a lower end of the door-side hinge in a vehicle up-down direction, wherein the body-side hinge includes a first side face member extending inwardly in the vehicle width direction from the connection part with the door-side hinge and extending in the vehicle up-down direction; and wherein a center of a rotation axis of the connection part between the body-side hinge and the door-side hinge intersects an extension line extending outwardly in the vehicle width direction from the first side face member, and wherein the first side face member becomes shorter in length along the vehicle width direction toward a lower side of the first side face member in the vehicle up-down direction from the connection part between the body-side hinge and the door-side hinge.

2. The vehicle door hinge structure according to claim 1, wherein the body-side hinge is further fixed to the pillar of the vehicle at a second fixing point being at a height higher than the lower end of the door-side hinge.

3. The vehicle door hinge structure according to claim 1, wherein the body-side hinge includes a second side face member extending in a vehicle front-rear direction and extending in the vehicle up-down direction, the second side face member being fixed to the pillar of the vehicle.

4. A vehicle door hinge structure comprising:

a door-side hinge fixed to a side door of a vehicle; and a body-side hinge including a connection part that is rotatably connected to the door-side hinge, the body-side hinge being fixed to a pillar of the vehicle at a first fixing point that is inward, in a vehicle width direction, of the connection part and the first fixing point being at a height below a lower end of the connection part in a vehicle up-down direction, wherein the body-side hinge includes a first side face member extending inwardly in the vehicle width direction from the connection part with the door-side hinge and extending in the vehicle up-down direction, wherein a center of a rotation axis of the connection part between the body-side hinge and the door-side hinge intersects an extension line extending outwardly in the vehicle width direction from the first side face member, and wherein the first side face member becomes shorter in length along the vehicle width direction toward a lower side of the first side face member in the vehicle up-down direction from the connection part between the body-side hinge and the door-side hinge.

5. The vehicle door hinge structure according to claim 4, wherein the body-side hinge is further fixed to the pillar of the vehicle at a second fixing point being at a height equal to or higher than the lower end of the connection part.

6. The vehicle door hinge structure according to claim 4, wherein the body-side hinge includes a second side face member extending in a vehicle front-rear direction and extending in the vehicle up-down direction, the second side face member being fixed to the pillar of the vehicle.

* * * * *